US009994979B2

(12) United States Patent
Kolmes et al.

(10) Patent No.: US 9,994,979 B2
(45) Date of Patent: Jun. 12, 2018

(54) LIGHTWEIGHT, CUT AND/OR ABRASION RESISTANT GARMENTS, AND RELATED PROTECTIVE WEAR

(75) Inventors: Nathaniel H. Kolmes, Conover, NC (US); Fred Driver, Conover, NC (US); Walter Schulein, Conover, NC (US); Glenn M. Fisher, Hickory, NC (US); Dan E. Brittain, Hickory, NC (US)

(73) Assignee: SUPREME CORPORATION, Conover, NC (US)

( * ) Notice: Subject to any disclaimer, the term of this patent is extended or adjusted under 35 U.S.C. 154(b) by 0 days. days.

(21) Appl. No.: 12/134,446

(22) Filed: Jun. 6, 2008

(65) Prior Publication Data

US 2009/0301139 A1 Dec. 10, 2009

(51) Int. Cl.

| | |
|---|---|
| ***D04B 1/16*** | (2006.01) |
| ***D02G 3/44*** | (2006.01) |
| ***A41B 11/00*** | (2006.01) |
| ***A41D 31/00*** | (2006.01) |
| ***D04B 1/18*** | (2006.01) |

(52) U.S. Cl.

CPC ..... *D04B 1/16* (2013.01); *A41B 11/00* (2013.01); *A41D 31/0055* (2013.01); *D02G 3/442* (2013.01); *D04B 1/18* (2013.01)

(58) Field of Classification Search

CPC ... D04B 1/16; D04B 1/18; D04B 7/34; D04B 9/58; A41B 11/00; D02G 3/32; D02G 3/328; D02G 3/442; D02G 3/443

USPC .... 66/202, 170, 171, 174; 57/210, 211, 224, 57/225, 230, 231; 2/22, 239

See application file for complete search history.

(56) References Cited

U.S. PATENT DOCUMENTS

| | | | | |
|---|---|---|---|---|
| 4,777,789 | A | 10/1988 | Kolmes et al. | |
| 4,838,017 | A | 6/1989 | Kolmes et al. | |
| 4,936,085 | A | 6/1990 | Kolmes et al. | |
| 5,119,512 | A | 6/1992 | Dunbar et al. | |
| 5,177,948 | A | 1/1993 | Kolmes et al. | |
| 5,248,548 | A * | 9/1993 | Toon | 428/222 |
| 5,382,264 | A | 1/1995 | Sharma | |
| 5,423,168 | A | 6/1995 | Kolmes et al. | |
| 5,500,025 | A | 3/1996 | Sharma | |
| 5,628,172 | A | 5/1997 | Kolmes et al. | |
| 5,632,137 | A | 5/1997 | Kolmes et al. | |
| 5,644,907 | A | 7/1997 | Kolmes et al. | |
| 5,655,358 | A | 8/1997 | Kolmes | |
| 5,845,476 | A | 12/1998 | Kolmes | |
| 6,212,914 | B1 | 4/2001 | Kolmes et al. | |
| 6,230,524 | B1 | 5/2001 | Kolmes et al. | |
| 6,341,483 | B1 | 1/2002 | Kolmes et al. | |
| 6,349,531 | B1 | 2/2002 | Kolmes et al. | |
| 6,351,932 | B1 | 3/2002 | Hummel | |
| 6,363,703 | B1 | 4/2002 | Kolmes | |

(Continued)

OTHER PUBLICATIONS

U.S. Appl. No. 12/206,834, filed Sep. 9, 2008, Schulein, et al.

(Continued)

*Primary Examiner* — Danny Worrell

(74) *Attorney, Agent, or Firm* — Oblon, McClelland, Maier & Neustadt, L.L.P.

(57) ABSTRACT

The present invention relates to a cut and/or abrasion resistant garment that is lightweight, has improved comfort, flexibility and pliability, and is particularly suitable for use as hosiery products such as stockings, pantyhose and tights, or for protective coverings for the arms of the wearer.

17 Claims, 1 Drawing Sheet

(56) References Cited

U.S. PATENT DOCUMENTS

| | | | | |
|---|---|---|---|---|
| 6,367,290 | B2 | 4/2002 | Kolmes et al. | |
| 6,381,940 | B1 | 5/2002 | Kolmes et al. | |
| 6,467,251 | B1 | 10/2002 | Kolmes | |
| RE38,136 | E | 6/2003 | Kolmes | |
| 6,581,366 | B1 * | 6/2003 | Andrews | 57/225 |
| 7,111,445 | B2 | 9/2006 | Threlkeld et al. | |
| 7,178,323 | B2 | 2/2007 | Kolmes et al. | |
| 7,214,425 | B2 | 5/2007 | Kolmes et al. | |
| 2005/0086924 | A1 | 4/2005 | Kolmes | |
| 2005/0186259 | A1 | 8/2005 | Threlkeld et al. | |
| 2006/0088712 | A1 | 4/2006 | Threlkeld et al. | |
| 2007/0094761 | A1 | 5/2007 | Kolmes et al. | |
| 2007/0099528 | A1 | 5/2007 | Kolmes et al. | |
| 2007/0137164 | A1 | 6/2007 | Kolmes et al. | |
| 2007/0144135 | A1 | 6/2007 | Kolmes et al. | |
| 2007/0271965 | A1 | 11/2007 | Kolmes et al. | |
| 2011/0167545 | A1 | 7/2011 | Garcia et al. | |

OTHER PUBLICATIONS

U.S. Appl. No. 12/538,218, filed Aug. 10, 2009, Schulein, et al.
U.S. Appl. No. 12/551,736, filed Sep. 1, 2009, Kolmes, et al.
U.S. Appl. No. 12/685,879, filed Jan. 12, 2010, Garcia, et al.
U.S. Appl. No. 14/023,977, filed Sep. 11, 2013, Kolmes, et al.
U.S. Appl. No. 10/972,332, filed Oct. 26, 2004, Threlkeld, et al.
U.S. Appl. No. 10/693,971, filed Oct. 28, 2003, Kolmes.
U.S. Appl. No. 10/785,060, filed Feb. 25, 2004, Threlkeld, et al.
U.S. Appl. No. 60/730,829, filed Oct. 28, 2005, Kolmes.
U.S. Appl. No. 11/251,928, filed Oct. 18, 2005, Kolmes, et al.
U.S. Appl. No. 11/263,851, filed Nov. 2, 2005, Kolmes, et al.
U.S. Appl. No. 11/439,273, filed May 24, 2006, Kolmes, et al.
U.S. Appl. No. 11/589,210, filed Oct. 30, 2006, Kolmes, et al.
U.S. Appl. No. 11/679,341, filed Feb. 27, 2007, Kolmes, et al.
U.S. Appl. No. 11/778,340, filed Jul. 16, 2007, Schulein.
U.S. Appl. No. 61/020,790, filed Jan. 14, 2008, Kolmes, et al.

* cited by examiner

LIGHTWEIGHT, CUT AND/OR ABRASION RESISTANT GARMENTS, AND RELATED PROTECTIVE WEAR

BACKGROUND OF THE INVENTION

Field of Invention

The present invention relates generally to protective garments that are lightweight, having improved comfort, flexibility and pliability, and are cut and/or abrasion resistant, particularly suitable for use as hosiery products such as pantyhose and tights, or for protective coverings for the limbs of the wearer.

Discussion of the Background

In many activities, it is desirable to provide protective garments, including undergarments, to protect participants from being cut. Ideally, such garments should be flexible, pliable, soft and cut/abrasion resistant. For activities in the sporting arena, the garments also need to be light weight, and preferably breathable and/or wicking to allow the removal and evaporation of perspiration from the athlete. Typically, any improvement in the cut and/or abrasion resistance has usually been at the sacrifice of the other properties. Protective garments have been made cut resistant in the past through the use of yarns which contain wire, fiberglass and high denier high performance yarns such as aramids. However, the use of wire is problematic in environments where a protective garment must not be electrically or thermally conductive. Moreover, experience has shown that the wire may break and injure the hand of the wearer. Lastly, articles or garments having a high wire content may be difficult and/or expensive to clean using conventional cleaning techniques. Further, the use of fiberglass can create significant problems with comfort, particularly in a light weight construction undergarment, as the glass fibers tend to cause significant skin irritation. Anyone that has worked with installing fiberglass batting as insulation can attest to this. The use of high denier high performance yarns such as aramids is problematic in causing the yarn and resultant garment to be too bulky for use, particularly in sporting applications.

In response to these problems, non-metallic cut-resistant yarns have been developed. These yarns have been described in U.S. Pat. Nos. 5,177,948 and 5,845,476 to Kolmes et al. which are owned by the assignee of the present invention. The contents of these patents are incorporated herein by reference. Kolmes '948 describes a yarn having substantially parallel core strands which may include fiberglass. Kolmes '476 describes other non-metal containing yarn constructions which contain fiberglass as a core yarn. However, these yarns are typically too bulky in denier to be used in undergarments, hosiery or other intimate apparel.

There remains a need for a cut and/or abrasion-resistant garment that is lightweight and suitable for use as hosiery, or other undergarment types having improved flexibility and softness.

SUMMARY OF THE INVENTION

Accordingly, one object of the present invention is to provide a cut and/or abrasion resistant garment that is lightweight, has improved comfort, flexibility and pliability.

A further object of the present invention is to provide a cut and/or abrasion resistant garment that is elastic.

A further object of the present invention is to provide a garment suitable for use as hosiery products, such as stockings, pantyhose, leggings or tights, or for use as a partial arm covering, which is also cut and/or abrasion resistant.

These and other objects of the present invention, alone or in combinations thereof, have been satisfied by the discovery of a cut and/or abrasion resistant knit garment, comprising at least one elastomeric yarn and at least one high performance yarn, wherein each yarn has a denier of from 10 to 300.

BRIEF DESCRIPTION OF THE DRAWINGS

The various benefits and advantages of the present invention will be more apparent upon reading the following detailed description of the invention taken in conjunction with the drawings.

In the drawings, wherein like reference numbers identify a corresponding component.

DETAILED DESCRIPTION OF THE INVENTION

Figure 1:
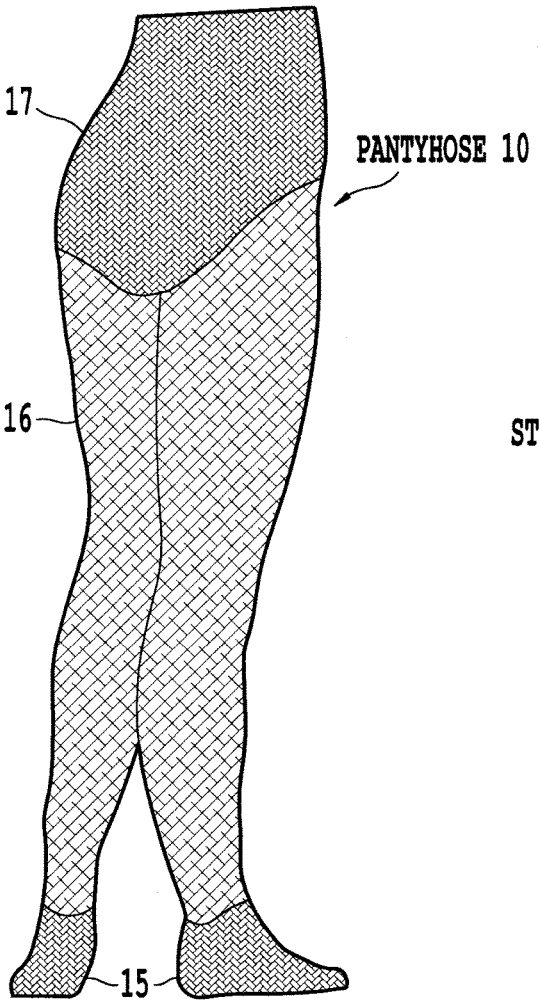
FIG. 1 illustrates an exemplary embodiment of the garment of the present invention, namely pantyhose (10) having a foot portion (15), a leg portion (16) and a panty portion (17).

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "intimate blend" as used herein refers to a mixture of fibers of at least two types, wherein the mixture is formed in such a way that the individual filaments of each type of fiber are substantially completely intermixed with individual filaments of the other types to provide a substantially homogeneous mixture of fibers, having sufficient entanglement to maintain its integrity in further processing and use.

The term "stretch broken" as used herein refers to a process in which fibers are hot stretched and broken to produce short fiber lengths, rather than cutting, in order to prevent some of the damage done by the cutting process.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consists of a single strand. A "blended yarn" as used herein refers to a yarn that comprises an intimate blend of at least two different types of fibers.

The term "end" as used herein refers to a single yarn ply used in preparation of multi-end yarns. The two or more ends may be put together by twisting together, wrapping a cover wrap around the combined ends or by air-interlacing as described below.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. No. 4,777,789, U.S. Pat. No. 4,838,017, U.S. Pat. No. 4,936,085, U.S. Pat. No. 5,177,948, U.S. Pat. No. 5,628,172, U.S. Pat. No. 5,632,137, U.S. Pat. No. 5,644,907, U.S. Pat. No. 5,655,358, U.S. Pat. No. 5,845,476, U.S. Pat. No. 6,212,914, U.S. Pat. No. 6,230,524, U.S. Pat. No. 6,341,483, U.S. Pat. No. 6,349,531, U.S. Pat. No. 6,363,703, U.S. Pat. No. 6,367,290, and U.S. Pat. No. 6,381,940, the contents of each of which are hereby incorporated by reference.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the relevant portions of which are hereby incorporated by reference.

The term "composite fabric" is used herein to indicate a fabric prepared from two or more different types of yarn or composite yarn. The fabric construction can be any type, including but not limited to, woven, knitted, non-woven, etc. The two or more different types of yarn or composite yarn include, but are not limited to, those made from natural fibers, synthetic fibers and combinations thereof.

The term "composite article" is used herein to indicate a final article that comprises at least two different types of materials. The composite article can be prepared from a composite fabric, or can be prepared from a conventional fabric containing only one type of yarn, but is put together using a yarn or sewing thread made of a different material. Alternatively, the conventional fabric can be sewn together using a composite yarn as the sewing thread. Composite articles can be any form, including but not limited to, gloves, aprons, socks, filters, shirts, pants, undergarments, one-piece jumpsuits, etc. All of these types of articles, as well as other permutations that are readily evident to those of skill in the art, are included in the present invention definition of "composite article".

For convenience, the term "yarn component" as used herein, encompasses fiber, monofilament, multifilament and yarn.

The present invention relates to lightweight garments that are cut and/or abrasion resistant, have stretch properties, and are particularly suitable for use as hosiery or tights. The garments have lower denier, softer feel, and more comfort for wearers of the garments, compared to garments made from conventional cut and/or abrasion resistant yarns. The garments include, but are not limited to, hosiery (including pantyhose), tights, leggings, arm coverings, etc. The garments can be made by knitting individual yarns of multiple types to create a composite article containing no composite yarns, as well as by knitting yarns of multiple types, wherein one or more of the yarns being knitted is a composite yarn.

One challenge has been to provide a fabric which can be made into articles such as undergarments, hosiery, socks, etc. which provide cut and/or abrasion resistance to the wearer. The garment of the present invention comprises a fabric selected from two basic types: 1) a fabric made by knitting together at least one high performance yarn and at least one elastomeric yarn, and 2) a fabric made by knitting at least one high performance yarn and at least one elastomeric yarn, with one or both of these being substituted by a composite yarn comprising one or both of these types of yarn. If the composite yarn is being used in place of the at least one high performance yarn, it does not need to contain any elastomeric yarn component. If the composite yarn is being used in place of the at least one elastomeric yarn, the composite yarn preferably comprises at least one elastomeric yarn in its core.

As the elastomeric yarn component, any elastomeric fiber may be used, as monofilament or multifilament yarn. Additionally, two or more elastomeric fibers can be combined in the core of a composite yarn, or used as a blend, twisted, in parallel, or air-tacked, etc. An elastomer is a natural or synthetic polymer that, at room temperature, can be stretched and expanded to typically twice its original length. After removal of the tensile load it will immediately return to its original length. Along with spandex, rubber and anidex (no longer produced in the United States) are considered elastomeric fibers. Spun from a block copolymer, spandex fibers exploit the high crystallinity and hardness of polyurethane segments, yet remain "rubbery" due to alternating segments of polyethylene glycol. Suitable elastomeric fibers include, but are not limited to, fibers made from copolymers having both rigid and flexible segments in the polymer chains, such as, for example, block copolymers of polyurethane and polyethylene glycol. Particularly suitable elastomeric fibers include, but are not limited to, Spandex, such as LYCRA (produced by United Yarn Products), ELASPAN (produced by Invista), DORLASTAN (produced by Bayer), CLEAR SPAN (produced by Radici) and LINEL (produced by Fillattice).

Elastomeric yarns can have one or more of the following materials properties: can be stretched over 500% without breaking; able to be stretched repetitively and still recover original length; lightweight; abrasion resistant; poor strength, but stronger and more durable than rubber; soft, smooth, and supple; resistant to body oils, perspiration, lotions, and detergents; no static or pilling problem; very comfortable; and easily dyed.

The elastomeric yarn can be any desired denier, preferably from 10 to 210, more preferably from 15 to 150, most preferably from 20 to 75. The elastomeric yarn can be used alone or combined with one or more other yarns of any desired type, so long as the combination retains its elastomeric properties. If combined with one or more other yarns, the elastomeric yarn and other yarns are preferably blended, or the one or more other yarns are wrapped around the elastomeric yarn to provide an elastomeric core composite yarn, thus retaining the stretch property.

Elastomeric yarn containing composite yarns are further described in U.S. Pat. Nos. 5,568,657 and 5,442,815, the contents of which are incorporated herein by reference. Elastomeric yarn containing composite yarns having wicking properties are described in U.S. Provisional Application Ser. No. 61/020,790, filed Jan. 14, 2008, the contents of which are hereby incorporated by reference.

The high performance fiber of the present invention can be any desired high performance fiber. Preferably the high performance fiber comprises a high molecular weight polyolefin, preferably high molecular weight polyethylene or high molecular weight polypropylene, an aramid, a high molecular weight polyvinyl alcohol, a high molecular weight polyacrylonitrile, liquid crystal polyesters or mixtures or copolymers thereof. The high performance fiber can also be a fiber blend, such as those described in U.S. Pat. No. 7,214,425, hereby incorporated by reference, wherein the high performance fiber is preferably included as a stretch broken fiber blended with one or more other yarns, which may also be high performance fibers themselves if desired.

U.S. Pat. No. 4,457,985, hereby incorporated by reference, generally discusses high molecular weight polyethylene and polypropylene fibers. In the case of polyethylene, suitable fibers are those of molecular weight of at least 150,000, preferably at least 400,000, more preferably at least one million and most preferably between two million and five million. Such extended chain polyethylene (ECPE) fibers may be grown in solution as described in U.S. Pat. No. 4,137,394 or U.S. Pat. No. 4,356,138, hereby incorporated by reference, or may be a filament spun from a solution to form a gel structure, as described in German Off. 3 004 699 and GB 2 051 667, and especially described in U.S. Pat. No. 4,551,296, hereby incorporated by reference. As used herein, the term polyethylene preferably means a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as lubricants, colorants and the like which are commonly incorporated by reference. Depending upon the formation technique, the draw ratio and temperatures, and other conditions, a variety of properties can be imparted to these fibers. The tenacity of the fibers should preferably be at least 15 g/d, more preferably at least 20 g/d, even more preferably at least 25 g/d and most preferably at least 28 g/d. Similarly, the tensile modulus of the filaments, as measured by an Instron tensile testing machine, is preferably at least 300 g/d, more preferably at least 500 g/d and still more preferably at least 1,000 g/d and most preferably at least 1,200 g/d. These highest values for tensile modulus and tenacity are generally obtainable only by employing solution grown or gel fiber processes. For example, high molecular weight polyethylene filaments produced commercially by Honeywell Corp. under the trade name SPECTRA or by DSM under the trade name DYNEEMA and having moderately high moduli and tenacity are particularly useful.

Similarly, highly oriented polypropylene of molecular weight at least 200,000, preferably at least one million and more preferably at least two million, may be used. Such high molecular weight polypropylene may be formed into reasonably well oriented fibers by techniques described in the various references referred to above, and especially by the technique of U.S. Pat. Nos. 4,663,101 and 4,784,820, hereby incorporated by reference, and U.S. patent application Ser. No. 069,684, filed Jul. 6, 1987 (see published application WO 89 00213). Since polypropylene is a much less crystalline material than polyethylene and contains pendant methyl groups, tenacity values achievable with polypropylene are generally substantially lower than the corresponding values for polyethylene. Accordingly, a suitable tenacity is at least about 8 g/d, with a preferred tenacity being at least about 11 g/d. The tensile modulus for polypropylene is at least about 160 g/d, preferably at least about 200 g/d.

In the case of aramid fibers, suitable aramid filaments formed principally from aromatic polyamide are described in U.S. Pat. No. 3,671,542, which is hereby incorporated by reference. Preferred aramid fiber will have a tenacity of at least about 20 g/d, a tensile modulus of at least about 400 g/d and an energy-to-break at least about 8 joules/g, and particularly preferred aramid fiber will have a tenacity of at least about 20 g/d, a modulus of at least about 480 g/d and an energy-to-break of at least about 20 joules/g. Most preferred aramid fiber will have a tenacity of at least about 20 g/d, a modulus of at least about 900 g/d and an energy-to-break of at least about 30 joules/g. For example, poly(p-phenylene terephthalamide) filaments produced commercially by Dupont Corporation under the trade name of KEVLAR and having moderately high moduli and tenacity values are particularly useful.

High molecular weight polyvinyl alcohol fibers having high tensile modulus are described in U.S. Pat. No. 4,440,711, hereby incorporated by reference. Particularly useful PV-OH fiber should have a modulus of at least about 300 g/d, a tenacity of at least about 7 g/d (preferably at least about 10 g/d, more preferably about 14 g/d, and most preferably at least about 17 g/d), and an energy-to-break of at least about 8 joules/g. PV-OH fiber having a weight average molecular weight of at least about 200,000, a tenacity of at least about 10 g/d, a modulus of at least about 300 g/d, and an energy to break of about 8 joules/g is more useful. PV-OH fiber having such properties can be produced, for example, by the process disclosed in U.S. Pat. No. 4,599,267.

In the case of polyacrylonitrile (PAN), PAN fibers for use in the present invention are of molecular weight of at least about 400,000. Particularly useful PAN fibers should have a tenacity of at least about 10 g/d and an energy-to-break of at least about 8 joules/g. PAN fibers having a molecular weight of at least about 400,000, a tenacity of at least about 15 to about 20 g/d and an energy-to-break of at least about 8 joule/g are most useful. Such fibers are disclosed, for example, in U.S. Pat. No. 4,535,027.

Useful liquid crystalline polymers include lyrotropic liquid crystalline polymers which include polypeptides such as poly γ-benzyl L-glutamate and the like; aromatic polyamides such as poly(1,4-benzamide), poly(chloro-1-4-phenylene terephthalamide), poly(1,4-phenylene fumaramide), poly(chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4-phenylene) (trans-1,4-cyclohexylene amide), poly(1,4-phenylene 1,4-dimethyl-trans-1,4-cyclohexylene amide), poly(1,4-phenylene 2,5-pyridine amide), poly(chloro-1,4-phenylene 2,5-pyridine amide), poly(3,3'-dimethyl-4,4'-biphenylene 2.5 pyridine amide), poly(1,4-phenylene 4,4'-stilbene amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly (4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; poly(amidehydrazides) such as poly(terephthaloyl 1,4 aminobenzhydrazide) and those prepared from 4-aminobenzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-b-oxy-1,4-phenyl-eneoxyteraphthaloyl) and poly(oxy-cis-1,4-cyclohexyleneoxycarbonyl-trans-1,4-cyclohexylenecarbonyl-b-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene)oxy-terephthaloyl) in 1,1,2,2-tetrachloroethane-o-chlorophenolphenol (60:25:15 vol/vol/vol), poly[oxy-trans-1,4-cyclohexyleneoxycarbonyl-trans-1,4-cyclohexylenecarbonyl-b-oxy(2-methyl-1,3-phenylene) oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyrotropic crystalline polymers with heterocyclic units such as poly(1,4-phenylene-2,6-benzobisthiazole) (PBT), poly(1,4-phenylene-2,6-benzobisoxazole) (PBO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline] poly[1,1'-(4,4'-biphenylene)-6,6'-bis(4-phenylquinoline)] and the like; polyorganophosphazines such as polyphosphazine, polybisphenoxyphosphazine, poly[bis(2,2,2' trifluoroethylene) phosphazine] and the like; metal polymers such as those derived by condensation of trans-bis(tri-n-butylphosphine) platinum dichloride with a bisacetylene or trans-bis(tri-n-butylphosphine)bis(1,4-butadinynyl)platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and hydroquinone and copolymers of poly(ethylene terephthalate) and p-hydroxybenzoic acid; and thermotropic polyamides and thermotropic copoly(amide-esters).

The high performance yarn can be any desired denier, preferably from 10 to 300, more preferably from 50 to 250, most preferably from 100 to 220.

If wicking properties are desired in the garment, one or more wicking yarns can be incorporated into the fabric making up the garment. The one or more wicking yarns can be used as one or more of the ends being knitted, can be air-tacked with one of the other yarns being knitted (such as the at least one elastomeric yarn or at least one high performance yarn), or can be part of a composite yarn that is used as one or more ends in the knitting process. Any wicking yarns can be used. Wicking yarns act by pulling moisture away from the wearer's skin, and permitting evaporation from the surface of the yarn, thus keeping the wearer drier. The wicking properties are conventionally provided by extruding the yarn (typically a hydrophilic yarn such as polyester, nylon or acrylic) such that it has one or more grooves or capillaries running lengthwise, which can move moisture away from the wearer through capillary action. Such capillary based fibers include, but are not limited to, COOLMAX fibers (by Invista), 4DG fibers and Q-WICK fibers (by Fiber Innovation Technology, Inc), and COOLNEW fibers (by Cyarn).

Additionally, wicking yarns can be prepared by use of a hydrophobic fiber, such as polyolefin fiber. Such fibers include, but are not limited to, DRYMAX fibers (by Drymax, LLC) and HYDROFIL fibers (Allied Signal). The wicking yarn can be any desired denier, and is preferably from 40 to 300 denier, more preferably from 50 to 200 denier, most preferably from 50 to 150 denier, and can be used as a single end or multiple ends.

If one or more ends being knitted is a composite yarn, each of the cover layers included within the composite yarn will have a wrapping rate, measured as turns per inch (tpi), which can be any desired amount sufficient to provide the integrity and workability of the yarn. Preferably the wrapping rate is from 4 to 19 tpi, more preferably from 6 to 12. Of course, the tpi will further depend on the denier of the yarn used for the cover layer and on the composite denier of the structure around which the cover layer is being wrapped. This variation in tpi can be readily determined by one of ordinary skill in the art.

If desired, the present invention garment, or the yarns used to make the garment, can be rendered antimicrobial, using the process described in U.S. Patent Publication 2005/0186259, the contents of which are hereby incorporated by reference. This can provide the wearer of articles made from the present invention yarn with added protection from infections microorganisms, as the antimicrobial treatment provides a "contact" kill of the microbe.

Additionally, it is possible to dye the entire garment in a single dye step, using the above noted antimicrobial treatment as a "dye auxiliary", as described in U.S. Patent Publication 2006/0088712, the contents of which are hereby incorporated by reference. This allows a one step dyeing to achieve uniform color of all components of the composite yarn. If antimicrobial properties are then desired, the antimicrobial treatment can then be applied again after dyeing.

In knitting the garment of the present invention, one can use any conventional knitting machine. The knitting machine can have any desired number of feeds, depending on the number needed to cover the number of yarn types being knitted and the speed at which the knitting will occur. Typically knitting machines have 2, 4 or 8 feeds, with the most common being 4 or 8 feeds. In a most preferred embodiment of the present invention, the garment is made using a 4 feed hosiery knitting machine. In knitting the garments of the present invention, each feed can use yarn having deniers ranging from 10 to 300 denier, preferably from 20-250 denier. The total denier of the yarns making up the garment can be any desired, depending on the weight of garment to be produced. In particular for hosiery and tights products, the total denier of yarns used is preferably from 100 to 800 denier, most preferably from 100 to 400. For heavier products such as leggings or arm coverings, the total denier of yarns used is preferably from 400 to 1400 denier.

In the knitting process, the differing yarns can be knit together as different ends, one or more types can be laid-in in the knitting process, ends can be plaited together, etc. Stitch types can be any desired, including but not limited to knit-tuck, jersey, and any stitch possible on 4 inch or larger circular knit equipment.

In an exemplary embodiment, a 4 feed knitting machine is used to knit at least one feed of high performance yarn and at least one feed of elastomeric yarn. If the high performance yarn and elastomeric yarn are the only yarns to be used in the construction of the garment, the 4 total feeds can be divided between the yarn types in any manner to obtain the desired properties in the knitted product. For example, the feeds can be evenly split with 2 feeds of high performance yarn and 2 feeds of elastomeric yarn to provide a hosiery product having a good balance of high cut and/or abrasion resistance and stretch properties, while maintaining light weight. If more stretch property is needed and less cut and/or abrasion resistance is acceptable, the feeds can be divided as 1 feed of high performance yarn and 3 feeds of elastomeric yarn. Alternatively, if less stretch is needed and more cut and/or abrasion resistance is desired, the feeds can be divided as 3 feeds of high performance yarn and 1 feed of elastomeric yarn.

As noted above, either or both of the high performance yarn and elastomeric yarn can be replaced with a composite yarn comprising either or both of a high performance yarn or elastomeric yarn. All feeds of the knitting process can use a composite yarn, so long as at least one of the feeds is a composite yarn containing an elastomeric yarn, preferably as its core, to provide the desired amount of stretch in the fabric.

As noted above, composite yarns can be made wicking and/or antimicrobial as desired. Additionally, one or more of the feeds of high performance yarn or elastomeric yarn can be substituted by a wicking yarn or antimicrobial yarn. Alternatively, a wicking yarn or other type of yarn can be air-tacked to either of the high performance yarn or elastomeric yarn as desired, preferably to the high performance yarn in order to preserve the full elasticity of the elastomeric yarn.

Figure 2:
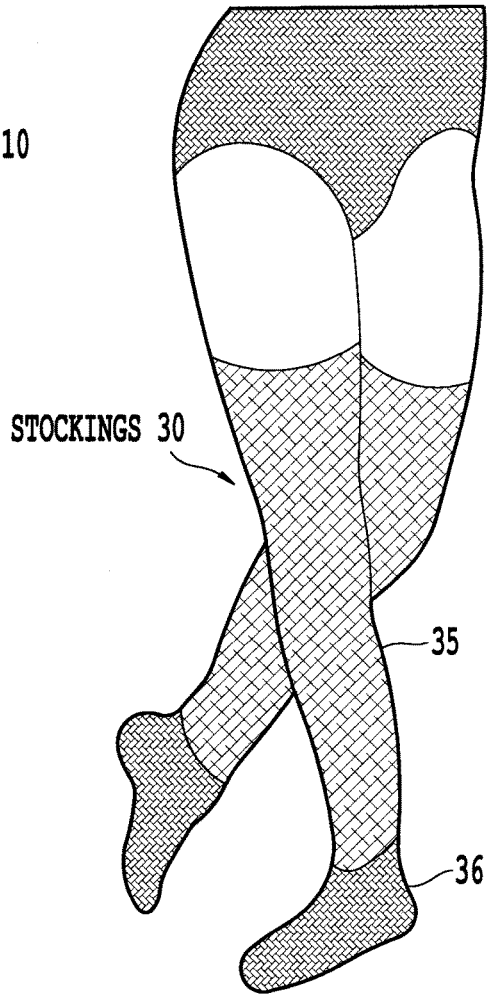
FIG. 2 illustrates an exemplary embodiment of the garment of the present invention, namely stockings (30) having a foot portion (35) and a leg portion (36).
Figure 3:
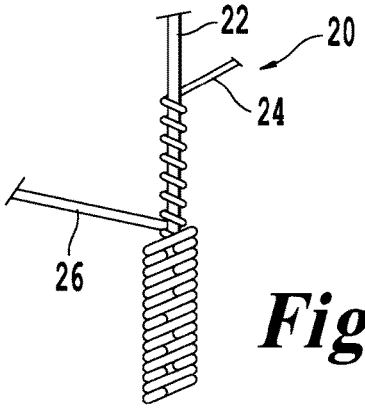
FIG. 3 illustrates an exemplary embodiment of a composite yarn (20) having a core (22), a first cover layer (24) and a second cover layer (26).

In a most preferred embodiment of the present invention, the garment is hosiery or tights. Hosiery is typically constructed as stockings or pantyhose. In stockings (30) (see FIG. 2), the knitting process can differentiate between the leg portion (35) and the foot portion (36). In pantyhose (10) (see FIG. 1), the leg (16) and foot (15) portion can be differentiated, and there is a third portion, the panty portion (17). In the present invention, the most important portion of hosiery for cut and/or abrasion resistance is the leg portion, particularly if the hosiery is to be used by competitive skaters, hockey players, or other professional athletes, where the foot has added protection from the skate or shoe. However, if desired, the entire stocking or pantyhose, or any combination of the foot, leg and/or panty, can be made as cut and/or abrasion resistant using the present invention, if desired.

Of course, in leggings, the entire leg covering would be according to the present invention most preferably. In tights, the leg portion or the panty portion or both could be made cut and/or abrasion resistant using the present invention. In the construction of arm coverings, the entire arm portion would preferably be made cut and/or abrasion resistant using the present invention.

This provides the present garments with the property of being light weight, having low denier of the component yarns, and being useful particularly as hosiery or tights, leggings, arm coverings, etc. In addition, it is possible to make the present garment in the form of an undershirt, underpants, socks, etc., if desired.

The garment of the present invention provides cut and/or abrasion resistance while maintaining a high level of comfort. Such garments are particularly useful to competitive ice skaters, hockey players, football players, bicyclists, motorcyclists, and a variety of other wearers engaged in activities likely to result in cuts or abrasion being inflicted on the body. The present invention has solved that problem by providing a fabric that is lightweight, breathable, can be made wicking and/or antimicrobial, and provides a high level of cut and/or abrasion resistance.

Although the present invention has been described with preferred embodiments, it is to be understood that modifications and variations may be utilized without departing from the spirit and scope of this invention, as those skilled in the art would readily understand. Such modifications and variations are considered to be within the purview and scope of the appended claims and their equivalents.

EXAMPLES

Suitable examples of high performance fibers used in the present invention include:

- 310 denier stretch broken blend of fiberglass, high molecular weight polyethylene and aramid, air-tacked to 70 denier high tenacity nylon
- 310 denier stretch broken blend of fiberglass, high molecular weight polyethylene and aramid, air-tacked to 150 denier polyester
- 220 denier high molecular weight polyethylene (DYNEEMA) air tacked to 100 denier high tenacity nylon Suitable composite yarns that can be used in place of either the elastomeric yarn or high performance yarn include:

1) core: 40 denier elastomeric yarn first cover: 220 denier high performance yarn (such as DYNEEMA)
second cover: 70 denier polyester or nylon, air-tacked with 70 denier COOLMAX wicking yarn 2) core: 40 denier elastomeric yarn
first cover: 220 denier high performance yarn
second cover: dyed polyester or nylon
third cover: COOLMAX 3) core: 40 denier elastomeric yarn
first cover: 220 denier high performance yarn
second cover: 70 denier wicking yarn (such as COOLMAX)

4) core: 40 denier elastomeric yarn
first cover: 70 denier flat polyester
second cover: 220 denier high performance yarn (such as DYNEEMA)

5) core: 10 denier elastomeric yarn
first cover: 70 denier flat polyester
second cover: 220 denier high performance yarn (such as DYNEEMA)

The invention claimed is:

1. A cut and/or abrasion resistant knit garment, consisting of:

at least one elastomeric yarn and at least one high performance yarn, wherein the at least one elastomeric yarn has a denier of from 10 to 150 and the at least one high performance yarn has a denier of from 10 to 220;

at least one of (a) one or more yarns selected from the group consisting of natural yarns, and synthetic yarns, or (b) one or more wicking yarns;

wherein the garment comprises yarns having a sum of all deniers of from 100 to 400, and wherein the garment exhibits elastic stretch properties.

2. The cut and/or abrasion resistant knit garment of claim 1, wherein the garment is a member selected from the group consisting of socks, stockings, and pantyhose.

3. The cut and/or abrasion resistant knit garment of claim 2, wherein the garment is stockings.

4. The cut and/or abrasion resistant knit garment of claim 3, wherein the stockings comprise a foot portion and a leg portion, wherein the leg portion contains the at least one elastomeric yarn and at least one high performance yarn.

5. The cut and/or abrasion resistant knit garment of claim 4, wherein both the foot portion and the leg portion contains the at least one elastomeric yarn and at least one high performance yarn.

6. The cut and/or abrasion resistant knit garment of claim 2, wherein the garment is pantyhose.

7. The cut and/or abrasion resistant knit garment of claim 6, wherein the pantyhose comprise a panty portion, a foot portion and a leg portion, wherein the leg portion contains the at least one elastomeric yarn and at least one high performance yarn.

8. The cut and/or abrasion resistant knit garment of claim 7, wherein both the foot portion and the leg portion contains the at least one elastomeric yarn and at least one high performance yarn.

9. The cut and/or abrasion resistant knit garment of claim 8, wherein each of the panty portion, foot portion and leg portion of the pantyhose contains the at least one elastomeric yarn and at least one high performance yarn.

10. The cut and/or abrasion resistant knit garment of claim 1, wherein the garment comprises fabric knit from at least 4 ends, wherein the at least 4 ends contain the at least one elastomeric yarn and at least one high performance yarn.

11. The cut and/or abrasion resistant knit garment of claim 1, wherein one or both of the at least one elastomeric yarn and at least one high performance yarn are a composite yarn.

12. The cut and/or abrasion resistant knit garment of claim 1, containing the at least one wicking yarn.

13. The cut and/or abrasion resistant knit garment of claim 1, wherein at least one yarn is antimicrobial.

14. The cut and/or abrasion resistant knit garment of claim 10, wherein the at least 4 ends contain at least 2 ends of elastomeric yarn and at least 2 ends of high performance yarn.

15. The cut and/or abrasion resistant knit garment of claim 11, wherein the elastomeric yarn is a composite yarn having an elastomeric yarn as core.

16. The cut and/or abrasion resistant knit garment of claim 15, wherein the composite yarn consists of at least one elastomeric yarn as core and a first cover layer of a member selected from the group consisting of high performance yarns, and at least one of natural yarns, synthetic yarns, and wicking yarns, wherein any one or more components of the composite yarn can optionally be antimicrobial.

17. The cut and/or abrasion resistant knit garment of claim 15, wherein the composite yarn consists of at least one elastomeric yarn as core, a first cover layer of at least one high performance yarn, and a second cover layer of one member selected from the group consisting of natural yarns, synthetic yarns, and wicking yarns, wherein any one or more components of the composite yarn can optionally be antimicrobial.

* * * * *